US007979001B2

(12) United States Patent
Miyata et al.

(10) Patent No.: US 7,979,001 B2
(45) Date of Patent: Jul. 12, 2011

(54) FIXING DEVICE, IMAGE FORMING APPARATUS AND ADJUSTMENT OF FIXING DEVICE

(75) Inventors: Toshiyuki Miyata, Kanagawa (JP); Chikara Ando, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 115 days.

(21) Appl. No.: 12/555,118

(22) Filed: Sep. 8, 2009

(65) Prior Publication Data

US 2010/0247182 A1 Sep. 30, 2010

(30) Foreign Application Priority Data

Mar. 26, 2009 (JP) ..... 2009-076315

(51) Int. Cl.
*G03G 13/20* (2006.01)

(52) U.S. Cl. ..... 399/122; 399/328; 430/124.32

(58) Field of Classification Search ..... 399/67, 399/68, 122, 320, 322, 328, 329; 430/124.3, 430/124.32
See application file for complete search history.

(56) References Cited

U.S. PATENT DOCUMENTS

2004/0197112 A1* 10/2004 Saito et al. ..... 399/69

FOREIGN PATENT DOCUMENTS

JP 2006-317881 11/2006
JP 2007-034068 2/2007

* cited by examiner

*Primary Examiner* — David P Porta
*Assistant Examiner* — Mark R Gaworecki
(74) *Attorney, Agent, or Firm* — Fildes & Outland, P.C.

(57) ABSTRACT

A fixing device includes: a fixing member that is driven to rotate; a pressurizing member that is rotated in accordance with rotation of the fixing member while pressing the fixing member, and that forms a pressing portion through which a recording medium passes, the pressing portion being formed between the pressurizing member and the fixing member; and a surface shape adjusting member that has a surface including plural spherical projections and that rotates with the surface being in contact with the fixing member.

10 Claims, 3 Drawing Sheets

FIXING DEVICE, IMAGE FORMING APPARATUS AND ADJUSTMENT OF FIXING DEVICE

CROSS REFERENCE TO RELATED APPLICATIONS

This application is based on and claims priority under 35 USC §119 from Japanese Patent Application No. 2009-076315 filed Mar. 26, 2009.

BACKGROUND

1. Technical Field

The present invention relates to a fixing device, an image forming apparatus and an adjustment method of a fixing device.

2. Related Art

In general, in electrophotographic image forming apparatuses, toner images formed on recording media such as sheets are fixed onto the recording media by a thermal pressure fixing method. In recent years, in fixing devices employing the thermal pressure fixing method, a superficial layer of a fixing member is formed in some cases by use of fluorine resin so that the surface of the fixing member has high releasability. Such a superficial layer made of fluorine resin has a relatively low level of hardness, and is likely to be damaged by an edge or a widthwise edge of a sheet supplied to a nip portion. To address this, there have been reported methods for preventing such damage traces and streaky traces from being transferred onto a surface of a fixed image, resulting in image defects.

SUMMARY

According to an aspect of the present invention, there is provided a fixing device including: a fixing member that is driven to rotate; a pressurizing member that is rotated in accordance with rotation of the fixing member while pressing the fixing member, and that forms a pressing portion through which a recording medium passes, the pressing portion being formed between the pressurizing member and the fixing member; and a surface shape adjusting member that has a surface including plural spherical projections and that rotates with the surface being in contact with the fixing member.

BRIEF DESCRIPTION OF THE DRAWINGS

Exemplary embodiment (s) of the present invention will be described in detail based on the following figures, wherein.

DETAILED DESCRIPTION

Hereinafter, a description will be given of exemplary embodiment to carry out the present invention. It should be noted that the present invention is not limited to the following exemplary embodiment, but may be embodied in several forms without departing from the gist thereof. In addition, the attached drawings are for explaining the present exemplary embodiment, and they do not show the real size.

(Image Forming Apparatus)

Figure 1:
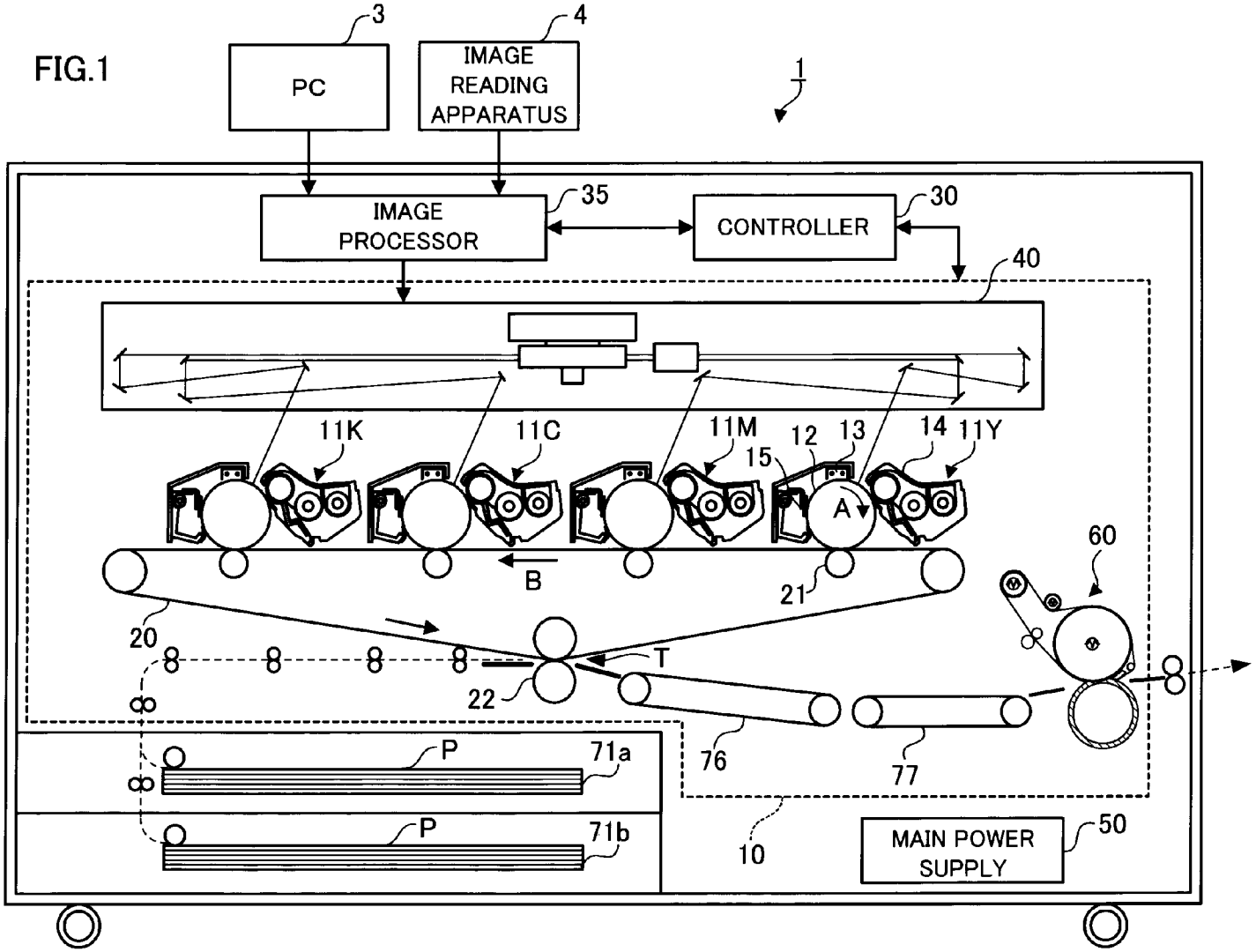
FIG. 1 is a schematic configuration diagram of an image forming apparatus to which the present exemplary embodiment is applied.

FIG. 1 is a diagram showing an entire configuration of an image forming apparatus 1 to which the present exemplary embodiment is applied. The image forming apparatus 1 shown in FIG. 1 is a color printer of a so-called tandem type. The image forming apparatus 1 includes: an image forming process unit 10 that forms an image in accordance with respective color image data; a controller 30 that controls operation of the entire image forming apparatus 1; an image processor 35 that is connected to an external apparatus such as a personal computer (PC) 3 and an image reading apparatus 4, and that performs an image processing on the received image data from these apparatuses; and a main power supply 50 that supplies electric power to respective units.

The image forming process unit 10 includes four image forming units 11Y, 11M, 11C and 11K (also collectively referred to as "image forming units 11"), each of which is an example of a toner image forming unit arranged in parallel at a regular interval. Each of the image forming units 11 includes a photoconductive drum 12, which is an example of an image carrier that forms an electrostatic latent image and that holds a toner image, a charging device 13 that uniformly charges a surface of the photoconductive drum 12 at a predetermined potential, a developing device 14 that develops the electrostatic latent image formed on the photoconductive drum 12, and a cleaner 15 that cleans the surface of the photoconductive drum 12 after transfer.

Each of the image forming units 11 is configured in a substantially similar manner, except for toner contained in the developing device 14. The image forming units 11 form yellow (Y), magenta (M), cyan (C) and black (K) toner images, respectively.

Furthermore, the image forming process unit 10 includes: a laser exposure device 40, an intermediate transfer belt 20, primary transfer rolls 21, a secondary transfer roll 22 and a fixing device 60. The laser exposure device 40 exposes the photoconductive drums 12 respectively disposed in the image forming units 11. Onto the intermediate transfer belt 20, respective color toner images formed on the photoconductive drums 12 of the image forming units 11 are superimposingly transferred. Each of the primary transfer rolls 21 sequentially transfers (primarily transfers) each color toner image formed in each of the image forming units 11 onto the intermediate transfer belt 20. The secondary transfer roll 22 collectively transfers (secondarily transfers), onto a sheet P as a recording medium (a recording paper), respective color toner images superimposingly transferred onto the intermediate transfer belt 20. The fixing device 60 is an example of a fixing unit (fixing device) that fixes the secondarily transferred respective color toner images onto the sheet P. It should be noted that, in the image forming apparatus 1 of the present exemplary embodiment, the intermediate transfer belt 20, the primary transfer roll 21 and the secondary transfer roll 22 configures a transfer unit.

In the image forming apparatus 1 of the present exemplary embodiment, image data inputted from the PC 3 or the image reading apparatus 4 is subjected to a image processing by the image processor 35, and then the resultant data are transmitted to the respective image forming units 11 via an interface (unillustrated). Then, for example, in the image forming unit 11Y that forms a yellow (y) toner image, while rotating in an arrow A direction, the photoconductive drum 12 is charged by the charging device 13, and is scanned and exposed by the laser exposure device 40 with laser light that is light-controlled on the basis of the image data transmitted from the image processor 35. Accordingly, on the photoconductive drum 12, an electrostatic latent image for a yellow (Y) image is formed. Then, the electrostatic latent image formed on the photoconductive drum 12 is developed by the developing device 14, and a yellow (Y) toner image is formed on the photoconductive drum 12. Similarly, in the image forming units 11M, 11C and 11K, magenta (M), cyan (C) and black (K) toner images are formed, respectively.

The respective color toner images formed in the image forming units 11 are electrostatically attracted in sequence, by the primary transfer rolls 21, onto the intermediate transfer belt 20 moving in an arrow B direction, and superimposed toner images that are obtained by superimposing the respective color toner images are formed. The superimposed toner images on the intermediate transfer belt 20 are transported to a region (a secondary transfer portion T) where the secondary transfer roll 22 is arranged in accordance with movement of the intermediate transfer belt 20. When the superimposed toner images are transported to the secondary transfer portion T, a sheet P is supplied to the secondary transfer portion T from any one of sheet holders 71*a* and 71*b* that has been selected, at right timing when the superimposed toner images are transported to the secondary transfer portion T. Then, the superimposed toner images are collectively and electrostatically transferred onto the sheet P that has been transported, by action of a transfer electric field formed at the secondary transfer portion T by the secondary transfer roll 22.

Subsequently, the sheet P onto which the superimposed toner images have been electrostatically transferred is peeled from the intermediate transfer belt 20, and is transported to the fixing device 60 by transportation belts 76 and 77. The toner images on the sheet P transported to the fixing device 60 are subjected to a fixing processing with heat and pressure by the fixing device 60 to be fixed on the sheet P. Then, the sheet P on which a fixed image has been formed is transported to an outputted sheet stacking part (unillustrated) provided in an output unit of the image forming apparatus 1.

As described above, image formation in the image forming apparatus 1 is repeatedly performed for the number of cycles same as the number of printout copies.

(Fixing Device)

Next, the fixing device 60 will be described.

Figure 2:
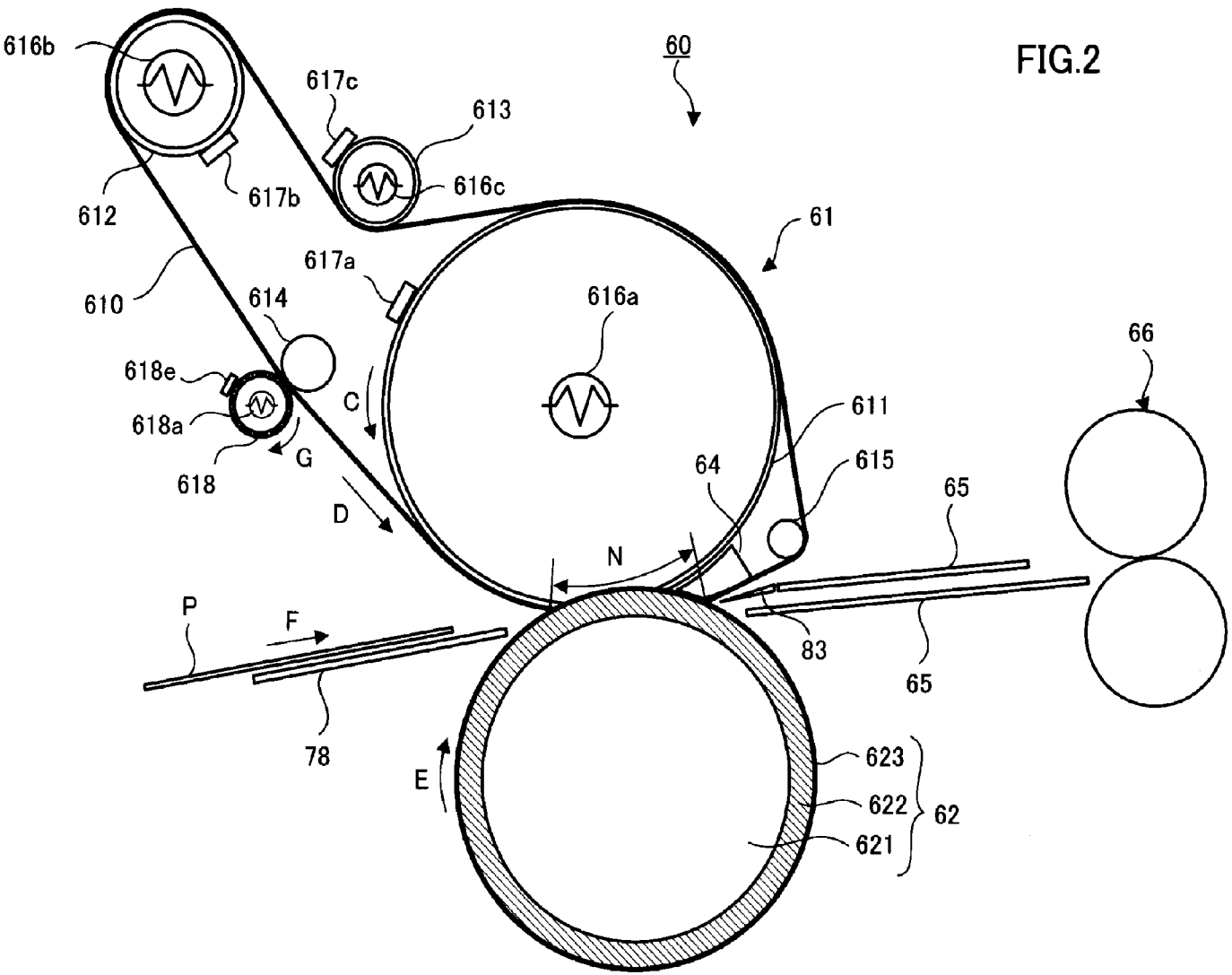
FIG. 2 is a cross-sectional view showing a schematic configuration of the fixing device.

FIG. 2 is a cross-sectional view showing a configuration of the fixing device 60 according to the present exemplary embodiment. This fixing device 60 includes: a fixing belt module (fixing member) 61; a pressure roll (pressurizing member) 62 arranged so as to be in pressure contact with the fixing belt module 61; and a surface shape adjusting roll (surface shape adjusting member) 618 that adjusts surface shapes of the fixing belt 610 while rotating with its surface being in contact with a fixing belt 610 of the fixing belt module 61. Here, the surface of the surface shape adjusting roll 618 includes plural spherical projections. The fixing belt 610 will be described later.

(Fixing Member)

The fixing belt module 61 includes: the fixing belt (an endless belt) 610, a fixing roll (a rotating member) 611, a tension roll 612, an external heating roll (a heating member) 613, a facing roll 614, a release pad (a release member) 64 and an idler roll 615. The fixing belt 610 is an example of a belt member. The fixing roll 611 is driven to rotate while having the fixing belt 610 laid around the fixing roll 611. The tension roll 612 stretches the fixing belt 610 from an inner side thereof. The external heating roll 613 stretches the fixing belt 610 from an outer side thereof. The facing roll 614 is provided in a position facing the surface shape adjusting roll 618 mentioned above with the fixing belt 610 interposed therebetween, while correcting state of the fixing belt 610 between the fixing roll 611 and the tension roll 612. The release pad 64 is arranged in the downstream side inside a nip portion (a pressing portion) N, and releases a sheet P from the fixing belt 610. The nip portion N is a region where the fixing belt module 61 and the pressure roll 62 are in pressure contact with each other. The idler roll 615 stretches the fixing belt 610 in a region downstream of the nip portion N between the nip portion N and a portion where the fixing belt 610 is again laid around the fixing roll 611.

The fixing roll 611 is, for example, a hard roll formed by having a cylindrical aluminum core roll (a core metal) film-coated with fluorine resin as a protective layer that prevents metal on a surface of the core roll from being worn. The core roll has an outer diameter of 65 mm, a length of 360 mm, and a thickness of 10 mm, and the fluorine resin film has a thickness of 200 μm. The fixing roll 611 rotates in an arrow C direction at a surface speed of, for example, 440 mm/s while receiving driving force from an unillustrated driving motor.

In addition, a halogen heater 616*a* rated at 900 W and serving as a heat source is disposed inside the fixing roll 611. The controller 30 (see FIG. 1) of the image forming apparatus 1 regulates the temperature on the surface of the fixing roll 611 so that the temperature keeps at 150 degrees C. on the basis of values measured by a temperature sensor 617*a*. The temperature sensor 617*a* is provided so as to come into contact with the surface of the fixing roll 611.

The fixing belt 610 is, for example, a deformable endless belt having a circumferential length of 314 mm and a width of 340 mm. The fixing belt 610 has a multilayer structure. For example, the fixing belt 610 includes: a base layer having a thickness of 80 μm and made of polyimide resin; an elastic body layer laminated on a front surface side (an outer circumference side) of the base layer, having a thickness of 200 μm and made of silicone rubber; and a release layer that film-coats the elastic body layer, and that is formed of, for example, a tetrafluoroethylene-perfluoroalkyl vinylether copolymer resin (PFA) tube having a thickness of 30 μm. The elastic body layer here is provided in order to enhance image quality of a color image by deforming the surface of the fixing belt 610 in accordance with irregularities of a toner image on the sheet P, and evenly supplying heat throughout the toner image. Note that, compositions of the fixing belt 610, such as materials, thicknesses, and levels of hardness, are selected in accordance with apparatus design conditions such as a purpose of use and conditions of use. Here, the fixing belt 610 is moved by the fixing roll 611 in an arrow D direction.

The tension roll 612 is, for example, a cylindrical roll having an outer diameter of 30 mm, a thickness of 2 mm, and a length of 360 mm and made of aluminum. A halogen heater 616*b* rated at 1500 W and serving as a heat source is disposed inside the tension roll 612. A temperature sensor 617*b* and the controller 30 (see FIG. 1) regulate the temperature on the surface of the tension roll 612 so that the temperature keeps at 190 degrees C.

Additionally, spring members (unillustrated) that press the fixing belt 610 outward are disposed in both end portions of the tension roll 612. Thereby, the tension roll 612 has a function of adjusting a tensile force of the fixing belt 610 to a predetermined value (for example, 15 kgf).

Furthermore, a belt edge position detecting mechanism (unillustrated) that detects a position of an edge of the fixing belt 610 is arranged near the tension roll 612. The tension roll 612 is provided with an axial displacement mechanism that displaces a contacting position of the fixing belt 610 in an axial direction thereof, in accordance with a detection result of the belt edge position detecting mechanism. With the axial displacement mechanism being provided, the tension roll 612 also functions as a meandering control roll (a steering roll) that controls meandering (belt walk) of the fixing belt 610.

The external heating roll 613 is, for example, a cylindrical roll having an outer diameter of 25 mm, a thickness of 2 mm, and a length of 360 mm, and made of aluminum. A halogen heater 616*c* rated at 1000 W and serving as a heat source is disposed inside the external heating roll 613. A temperature sensor 617*c* and the controller 30 (see FIG. 1) regulate the temperature on the surface of the external heating roll 613 so that the temperature keeps at 190 degrees C.

As mentioned above, the surface temperature of the fixing belt 610 that is laid around the fixing roll 611, the tension roll 612 and the external heating roll 613 differs between circumferential portions. Here, a temperature thereof is generally 180 degrees C. to 185 degrees C., for example, at a position thereof with which the surface shape adjusting roll 618 is in pressure contact.

The surface shape adjusting roll 618 is provided downstream of the tension roll 612 and the external heating roll 613 mentioned above in a rotation direction of the fixing belt 610. In other words, the surface shape adjusting roll 618 is provided so as to be located upstream of the nip portion N and closest to the nip portion N. The surface shape adjusting roll 618 has a halogen heater 618*a*, serving as a heating unit, disposed therein, and is, for example, a cylindrical roll having an outer diameter of 30 mm and a length of 350 mm. Spring members (unillustrated) are disposed in both end portions of the surface shape adjusting roll 618, and press the surface of the fixing belt 610 generally at a surface pressure of 2 kgf/cm$^2$ to 5 kgf/cm$^2$, preferably at a surface pressure of 2.5 kgf/cm$^2$ to 3 kgf/cm$^2$. The surface shape adjusting roll 618 will be described later.

Additionally, the facing roll 614 provided in a position facing the surface shape adjusting roll 618 with the fixing belt 610 interposed therebetween is, for example, a sponge roll having an outer diameter of 20 mm and a length of 380 mm and having an elastic layer.

The release pad 64 is a block member whose cross section is substantially arc shaped. The release pad 64 is formed of a rigid body of, for example, metal such as SUS or resin having high rigidity. Additionally, the release pad 64 is arranged over the entire region along an axial direction of the fixing roll 611 and fixed at a portion around downstream of a region where the pressure roll 62 is in pressure contact with the fixing roll 611 with the fixing belt 610 interposed therebetween. Furthermore, the release pad 64 is placed so as to bring the fixing belt 610 into pressure contact with the pressure roll 62 uniformly with a predetermined load (for example, 10 kgf).

Additionally, the idler roll 615 is, for example, a columnar roll having an outer diameter of 12 mm and a length of 360 mm, and made of stainless steel. The idler roll 615 is arranged around downstream of the release pad 64 in a moving direction of the fixing belt 610 so that the fixing belt 610 having passed through the nip portion N may smoothly move toward the fixing roll 611.

(Pressurizing Member)

The pressure roll 62 is a soft roll, for example, including a columnar roll 621 used as a base body, and is formed by laminating an elastic layer 622 and a release layer 623 sequentially from the base body. The columnar roll 621 has a diameter of 45 mm and a length of 360 mm, and is made of aluminum. The elastic layer 622 has a thickness of 10 mm and is made of silicone rubber. The release layer 623 is formed of a PFA tube having a film thickness of 100 μm. Additionally, the pressure roll 62 is placed so as to be in pressure contact with the fixing belt module 61, and is rotated in an arrow E direction in accordance with rotation of the fixing roll 611 of the fixing belt module 61 in the arrow C direction. A moving speed of the pressure roll 62 is 440 mm/s, which is the same as the surface speed of the fixing roll 611.

(Surface Shape Adjusting Roll 618)

Next, the surface shape adjusting roll 618 of the surface shape adjusting member will be described.

Figure 3A:
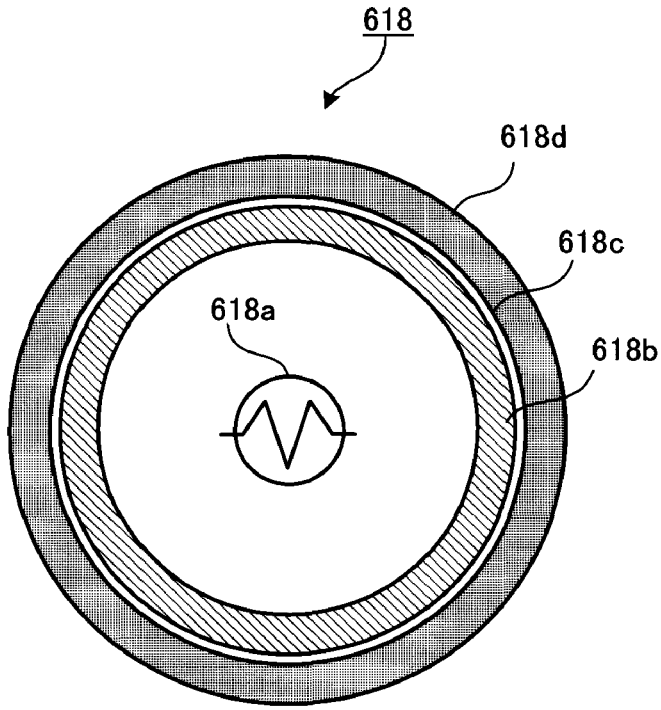
FIGS. 3A and 3B are views illustrating a cross-sectional structure of the surface shape adjusting roll in the exemplary embodiment.
Figure 3B:
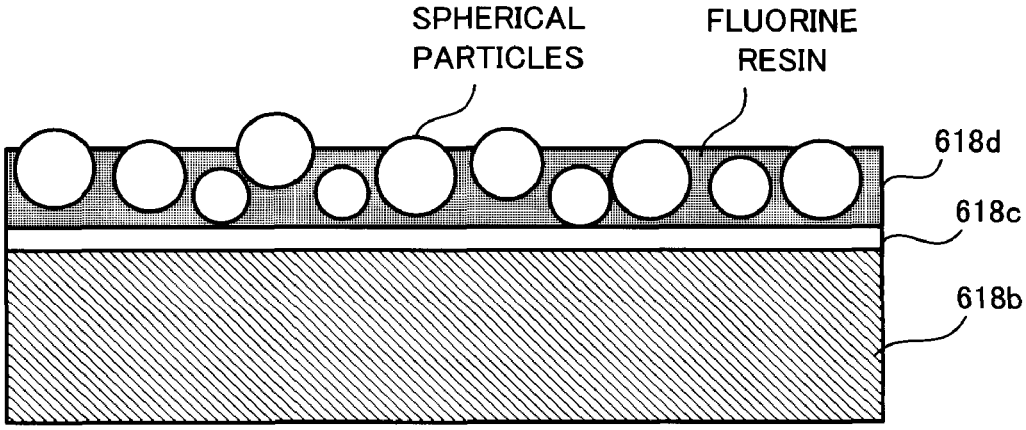

FIGS. 3A and 3B are views illustrating a cross-sectional structure of the surface shape adjusting roll 618 in the present exemplary embodiment. As shown in FIG. 3A, the surface shape adjusting roll 618 includes: a base body 618*b* formed of a metallic columnar roll; and a surface layer 618*d* coming into contact with the fixing belt 610 (see FIG. 2).

The surface layer 618*d* coming into contact with the fixing belt 610 has plural spherical projections (unillustrated). In the present exemplary embodiment, the spherical projections having a maximal diameter in a range of about 10 μm to about 50 μm, preferably about 20 μm to about 40 μm, are formed on the surface layer 618*d*. Here, the number of the spherical projections lying on the surface layer 618*d* is in a range of about 100 per square millimeter to about 150 per square millimeter, preferably about 120 per square millimeter to about 140 per square millimeter, for example, in a case where a metallic roll core having an axial direction length of 350 mm and a diameter of ϕ 30 and made of SUS is used as the base body 618*b* (the surface area is approximately 3300 square millimeter).

Note that, in the present exemplary embodiment, the height of each spherical projection of the surface layer 618*d* is, generally, preferably in a range of 20 μm to 30 μm.

If the maximal diameter of each spherical projection is excessively small, the spherical projections of a shape having a small diameter are to be provided to the surface of the fixing belt 610. Accordingly, less scattering light is generated on a surface of an image, and thus the function by which thrust damages generated on the surface of the fixing belt 610 are made inconspicuous is more likely to deteriorate.

If the maximal diameter of each spherical projection is excessively large, the spherical projections of a shallow shape are to be provided to the surface of the fixing belt 610. Accordingly, scattering light is hardly generated on a surface of an image, and thus the function by which thrust damages generated on the surface of the fixing belt 610 are made inconspicuous is more likely to deteriorate.

If the number of the spherical projections formed on the surface layer 618*d* is excessively small, less scattering light is generated on a surface of an image. Then, the function by which thrust damages generated on the surface of the fixing belt 610 are made inconspicuous is more likely to deteriorate.

If the number of the spherical projections formed on the surface layer 618*d* is excessively large, more scattering light is generated on a surface of an image. Then, image gloss is more likely to deteriorate.

Having the plural spherical projections formed on the surface layer 618*d* allows the plural spherical recesses, which correspond to particle diameters of spherical particles, to be provided to the surface of the fixing belt 610.

Providing spherical recesses to the surface of the fixing belt 610 by the projections, influences of damages caused on the fixing belt 610 are reduced. Accordingly, occurrence of image defects attributable to thrust damages generated on the fixing belt 610 is reduced.

Note that, at this time, it is preferable in the present exemplary embodiment that the surface of the fixing belt 610 be adjusted so as to have a surface roughness Ra in a range of 0.5 μm to 0.2 μm, particularly 0.1 μm to 0.15 μm.

Next, FIG. 3B is a view illustrating a structure of the surface layer 618*d* formed of fluorine resin and spherical particles. In the present exemplary embodiment, the surface layer 618*d*, having a thickness of 17 μm, contains the fluorine resin and the spherical particles having an average particle diameter of about 10 μm to about 50 μm. In addition, the surface layer 618*d* is fixedly mounted on the base body 618*b* with a primer layer 618*c* having a thickness of 5 μm interposed therebetween.

The fact that the surface layer 618*d* contains the fluorine resin and the spherical particles having an average particle diameter of about 10 μm to about 50 μm allows plural spherical projections to be formed on a surface that comes into contact with the fixing belt 610. Specifically, depending on a diameter of the spherical particles, spherical recesses that correspond to particle diameters of the spherical particles are allowed to be provided to the surface of the fixing belt 610. Additionally, occurrence of image defects attributable to thrust damages generated on the surface of the fixing belt 610 is allowed to be reduced.

Listed as examples of the spherical particles contained in the surface layer 618*d* are: inorganic spherical particles such as glass beads, alumina particles and silica particles; carbon-based spherical particles such as carbon beads; and organic spherical particles such as spherical epoxy beads and granular phenolic resin. Spherical metal powders of zinc, lead, nickel, aluminum, copper, iron, stainless steel or the like may also be employed. Among these examples, use of inorganic spherical particles is preferable, and use of alumina particles is particularly preferable.

Otherwise, among materials having been conventionally known as fillers, any one of those having forms of spherical particles may be employed to form the surface layer 618*d* in combination with fluorine resin. Listed as examples of such a filler are silicon carbide, barium sulfate, graphite, magnesium sulfate, calcium carbonate, magnesium carbonate, antimonous oxide, titanium oxide, zinc oxide, ferric oxide and zinc sulfide.

Furthermore, as a type of the spherical particles, microballoons, which are hollow particles, may also be used. Listed as examples of such microballoons are: inorganic microballoons such as alumina bubbles made of alumina, Kanamite made of shale, cenospheres made of fly ash, shirasu balloons made of shirasu, silica balloons made of silica sand, diaballoons made of volcanic rock, a glass balloon made of silicate soda or borax, and perlite balloons made of perlite or obsidian; carbon-based microballoons such as carbospheres formed of baked phenolic microballoons, Krecasphere made of pitch, and carbon hollow spheres made of coal; and organic microballoons such as phenol microballoons made of phenol resin, saran microspheres made of polyvinylidene chloride, Ecosphere EP made of epoxy resin, and Ecosphere VF-O made of carbon resin.

Listed as examples of the fluorine resin contained in the surface layer 618*d* are: polytetrafluoroethylene (PTFE); tetrafluoroethylene-perfluoro arkylvinylether copolymer (PFA) such as tetrafluoroethylene-perfluoro methylvinylether copolymer (MFA), tetrafluoroethylene-perfluoro ethylvinylether copolymer (EFA) and tetrafluoroethylene-perfluoro propylvinylether copolymer; and the like. Furthermore, tetrafluoroethylene-hexafluoropropylene copolymer (FEP), ethylene-tetrafluoroethylene copolymer (ETFE), polyvinylidene fluoride (PVDF), polychlorotrifluoroethylene (PCTFE), polyvinyl fluoride (PVF) and the like are also listed.

Among those fluorine resins, suitably employed in terms of heat resistance and mechanical properties is: polytetrafluoroethylene (PTFE); tetrafluoroethylene-perfluoro arkylvinylether copolymer (PFA) such as, tetrafluoroethylene-perfluoro methylvinylether copolymer (MFA) or tetrafluoroethylene-perfluoro ethylvinylether copolymer (EFA); or tetrafluoroethylene-hexafluoropropylene copolymer (FEP).

The fluorine resin contained in the surface layer 618*d* prevents toners attaching to the surface of the surface shape adjusting roll 618, thereby maintaining performance of the surface shape adjusting roll 618 for a long period.

In the present exemplary embodiment, the relative amount of the spherical particles to the fluorine resin in the surface layer 618*d* is generally not less than 5 wt %, preferably not less than 20 wt %, particularly preferably not less than 30 wt % per 100 wt % of the fluorine resin. Here, the relative amount is generally not more than 50 wt %, preferably not more than 40 wt %. If the relative amount of the spherical particles to the fluorine resin is excessively small, the number of the projections of the surface layer 618*d* is reduced. Accordingly, the effect of providing the recesses on the surface of the fixing belt 610 is likely to be reduced.

On the other hand, if the relative amount of the spherical particles is excessively large, the extreme pressure property between the projections of the surface layer 618*d* and the fixing belt 610 is reduced. Accordingly, the effect of providing the recesses on the surface of the fixing belt 610 is likely to be reduced.

It is preferable that the thickness of the surface layer 618*d* be generally not less than one half and not more than two thirds of sizes of the spherical particles used. If the thickness of the surface layer 618*d* is excessively thin, the spherical particles are likely to fall off. On the other hand, if the thickness of the surface layer 618*d* is excessively thick, heights of the spherical particles projecting from the surface becomes small, so that a surface adjustability thereof is likely to deteriorate.

The primer layer 618*c* functions as a bonding layer that bonds the surface layer 618*d* onto the base body 618*b* in such a way that the surface layer 618*d* covers the base body 618*b*. As materials forming the primer layer 618*c*, addition reaction silicone rubber, a silane coupling agent and an epoxy-based adhesive are listed as examples.

The base body 618*b* and the surface layer 618*d* are allowed to be bonded together by forming the primer layer 618*c* by use of these materials.

Note that, in the present exemplary embodiment, while the halogen heater 618*a* rated at 500 W and serving as the heating unit is disposed inside the base body 618*b* constituting the surface shape adjusting roll 618, the controller 30 (see FIG. 1) of the image forming apparatus 1 regulates, on the basis of values measured by a temperature sensor 618*e* arranged so as to come into contact with the surface of the surface layer 618*d*, a surface temperature of the surface shape adjusting roll 618 so that the surface temperature thereof is set higher than a surface temperature of the fixing belt 610.

Setting the surface temperature of the surface shape adjusting roll 618 higher than the surface temperature of the fixing belt 610 results in reduction of an amount of toner adhered to the surface of the surface shape adjusting roll 618. Here, the surface temperature of the surface shape adjusting roll 618 is set higher generally by 10 degrees C. or more than the surface temperature of the fixing belt 610, preferably by 15 degrees C. or more than the surface temperature of the fixing belt 610. The surface temperature of the surface shape adjusting roll 618 is generally set to not more than 250 degrees C. so as to be not more than an upper temperature limit.

Note that the base body 618*b* is, for example, a columnar roll having an outer diameter of 30 mm and a length of 350 mm and made of stainless steel (SUS).

(Preparative Procedure for Surface Shape Adjusting Roll 618)

Although a preparative procedure for the surface shape adjusting roll 618 is not particularly limited, exemplified is a procedure in which: coating solution obtained by solving the fluorine resin and the spherical particles into a common solvent is prepared; and this coating solution is applied to the surface of the base body 618*b*.

Specifically, firstly, a primer is applied to the surface of the base body 618*b* formed of a columnar roll by flow coating, and then, is subjected to a baking process to form the primer layer 618*c*. Subsequently, the coating solution obtained by solving the fluorine resin and the spherical particles into a common solvent is applied to the thus formed primer layer 618*c* by flow coating, and then, is subjected to a baking process to form the surface layer 618*d*, whereby the surface shape adjusting roll 618 is obtained.

Here, although the solvent, used to obtain the coating solution, into which the fluorine resin and the spherical particles are solved is not particularly limited, dichlorodifluoromethane, trichlorofluoromethane, chlorodifluoromethane, 1,1,2-trichloro-1,2,2-trifluoroethane, 1,2-dichloro-1,1,2,2-tetrafluoroethane, 1,1,2,2-tetrachloro-1,2-difluoroethane, perfluorocyclobutane, perfluorodimethylcyclobutane and the like are listed as examples thereof.

In addition to the above described solvent, small amounts of alcohol, ketone, ether and the like may be contained. As examples of the alcohol, methanol, ethanol, isopropanol and the like are listed. As examples of the ketone, acetone and the like are listed. As examples of the ether, tetrahydrofuran and the like are listed. It is preferable that a content of each of these alternative solvents be not more than 10 wt % of all the solvents.

Additionally, a concentration of the fluorine resin in the coating solution is generally in a range of 0.5 wt % to 25 wt %, preferably in a range of 2 wt % to 20 wt %. If the concentration of the fluorine resin is excessively low, formation of a coating film having no pin holes generated therein is likely to be difficult. On the other hand, if the concentration of the fluorine resin is excessively high, liquidity of the coating solvent is likely to be reduced.

Note that, instead of the above described preparative procedure, for example, another procedure may be employed in which, the base body 618*b* is soaked in the above described coating solution containing the fluorine resin and the spherical particles, then is pulled up, and thereafter, the solvent is removed.

By use of such a preparative procedure, the surface layer 618*d* of the surface shape adjusting roll 618 is prepared. At this time, it is preferable that the surface roughness Ra of the surface layer 618*d* be adjusted so as to be 2 μm to 10 μm, preferably 4 μm to 5 μm.

(Description of Fixing Operations in Fixing Device 60)

Next, fixing operations in fixing device 60 of the present exemplary embodiment will be described.

The sheet P, onto which an unfixed toner image has been electrostatically transferred in the secondary transfer unit T (see FIG. 1) of the image forming apparatus 1, is transported toward the nip portion N of the fixing device 60 (see FIG. 2, in an arrow F direction) by the transportation belts 76 and 77, and an entrance guide 78 of the fixing device 60. Then, the unfixed toner image on the surface of the sheet P passing through the nip portion N is fixed on the sheet P with pressure and heat acting on the nip portion N.

The sheet P passing through the nip portion N reduces its adherence to the fixing belt 610 having been largely warped by having the release pad 64 pressed by the pressure roll 62, and is thus released from the fixing belt 610 with stiffness that the sheet P itself has.

Then, the sheet P having been separated from the fixing belt 610 is guided by a release guiding plate 83 disposed downstream of the nip portion N, and then, is outputted to the outside of the apparatus by sheet exit guides 65 and sheet exit rolls 66 (see FIG. 2), whereby fixing processing is completed.

Next, when the fixing device 60 is in operation, generally, a load of 20 kgf is applied to the surface shape adjusting roll 618 through the spring members (unillustrated) disposed on both of the end portions of the surface shape adjusting roll 618. Thereby, the surface shape adjusting roll 618 comes into contact with the surface of the fixing belt 610. Then, the fixing belt 610 is sandwiched between the surface shape adjusting roll 618 and the facing roll 614. The surface shape adjusting roll 618 is rotated in an arrow G direction in accordance with the rotation of the fixing belt 610.

The fact that the surface shape adjusting roll 618 is rotated in accordance with the rotation of the fixing belt 610 allows recesses to be provided to the surface of the fixing belt 610. The shapes of the recesses are similar to thrust damages generated on the surface of the fixing belt 610 due to the sheet.

Additionally, at this time, the temperature of the surface layer 618*d* is maintained to be higher than the surface temperature of the fixing belt 610 by the halogen heater 618*a* provided inside the surface shape adjusting roll 618. Thereby the toner remaining on the surface of the fixing belt 610 is prevented from attaching to the surface of the surface shape adjusting roll 618.

Note that, at this time, the surface shape adjusting roll 618 receives a surface pressure of 2 kgf/cm$^2$ to 3 kgf/cm$^2$. The surface temperature of the fixing belt 610 is 150 degrees C. to 200 degrees C.

Next, in a case where the surface layer 618*d* contains the fluorine resin and the spherical particles having an average particle diameter of 2 μm to 50 μm, the surface shapes of the fixing belt 610 are adjusted in accordance with a kind of the spherical particles.

For example, in a case where the spherical particles are alumina ($Al_2O_3$) particles having an average particle diameter of about 10 μm to about 50 μm, spherical recesses corresponding to shapes of the alumina particles are provided to the surface of the fixing belt 610 by pressing the spherical particles contained in the surface layer 618*d* against the fixing belt 610. Thereby, the amount of scattering light on the surface of the toner image is increased, whereby a contrast difference between a part of the fixing belt 610 having a thrust damage or a streaky trace generated thereon, and the other part thereof is decreased.

EXAMPLE

The present invention will be more specifically described below based on an example and comparative examples. Note that the present invention is not limited to the following example insofar as not departing from the gist thereof.

(1) Grade Assessment Method for Thrust Damages

By use of the fixing device 60 shown in FIG. 2, 1,000 pieces of cardboard (209 gsm) are fed through. Thereafter, an entirely solid image in process black is formed on cast-coated paper on which thrust damages notably appear. Grades of thrust damages are assessed in accordance with the following criteria:

"G0" for when no thrust damages are generated,

"G1" for when thrust damages are generated, but are almost inconspicuous,

"G2" for when thrust damages are generated, and are a little conspicuous,

"G3" for when thrust damages are generated, and are fairly conspicuous, and

"G4" for when thrust damages are generated, and are extremely conspicuous.

(2) Number of Spherical Projections Lying on Surface Layer 618*d* of Surface Shape Adjusting Roll 618

The number of the spherical projections having a maximal diameter of 10 μm to 50 μm is measured by use of an optical microscope.

Example 1

In the fixing device 60 shown in FIG. 2, the surface shape adjusting roll 618 is formed by including, as the base body 618*b*, a metallic roll core having an axial direction length of 350 mm and a diameter of ϕ 30 and made of SUS. The surface layer 618*d* containing 30 wt % of spherical particles of aluminum oxide ($Al_2O_3$) per 100 wt % of PFA resin is laminated on the surface of the base body 618*b* with the primer layer 618*c* interposed therebetween. Here, the spherical particles have an average particle diameter of 30 μm. At this time, the thickness of the surface layer 618*d* of the surface shape adjusting roll 618 is 17 μm. Additionally, the number of the spherical projections lying on the surface layer 618*d* is 130 per square millimeter.

Note that the surface roughness Ra of the surface layer 618*d* caused to come into contact with the fixing belt 610 is 4 μm to 5 μm.

Next, while a load of 20 kgf is applied to the surface shape adjusting roll 618, the surface shape adjusting roll 618 is brought into contact with the surface of the fixing belt 610. Then, the surface shape adjusting roll 618 and the facing roll 614 having the elastic layer and having a diameter of ϕ 20 sandwich the fixing belt 610. The surface shape adjusting roll 618 is caused to be rotated in accordance with the rotation of the fixing belt 610. Additionally, the halogen heater 618*a* provided inside the surface shape adjusting roll 618 is caused to heat the surface layer 618*d* so that the temperature of the surface layer 618*d* becomes 195 degrees C. to 200 degrees C.

Note that, at this time, the surface shape adjusting roll 618 receives a surface pressure of 2 kgf/cm$^2$ to 3 kgf/cm$^2$. The surface temperature of the fixing belt 610 is 180 degrees C. to 190 degrees C.

Subsequently, the fixing device 60 is set in operation, and the grade assessment of thrust damages is conducted according to the above mentioned assessment method. The result of the grade assessment is the grade G1 (thrust damages are generated but are almost inconspicuous).

Comparative Example 1

The grade assessment of thrust damages is conducted in the same manner as Example 1 except the surface shape adjusting roll 618. Specifically, the surface layer 618*d* containing 30 wt % of spherical particles of silicon carbide (SiC) per 100 wt % of PFA resin is prepared by flow coating on the surface of the base body 618*b*. Here, the silicon carbide does not include spherical particles having an average diameter of 30 μm. The result of the grade assessment is the grade G4 (thrust damages are generated and are extremely conspicuous).

Comparative Example 2

The grade assessment of thrust damages is conducted in the same manner as Example 1 except that surface shape adjusting roll 618 is not used. The result of the grade assessment is the grade G4 (thrust damages are generated and are extremely conspicuous).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that is driven to rotate;

a pressurizing member that is rotated in accordance with rotation of the fixing member while pressing the fixing member, and that forms a pressing portion through which a recording medium passes, the pressing portion being formed between the pressurizing member and the fixing member; and a surface shape adjusting member that has a surface including a plurality of spherical projections and that rotates with the surface being in contact with the fixing member.

2. The fixing device according to claim 1, wherein the surface shape adjusting member adjusts surface shapes of the fixing member by providing a plurality of spherical recesses to a surface of the fixing member using the plurality of spherical projections while rotating with the surface thereof being in contact with the fixing member.

3. The fixing device according to claim 1, wherein the projections of the surface shape adjusting member have a maximal diameter of about 10 μm to about 50 μm.

4. The fixing device according to claim 1, wherein the number of the projections of the surface shape adjusting member is about 100 per square millimeter to about 150 per square millimeter.

5. The fixing device according to claim 1, wherein the surface shape adjusting member includes:

a base body that is formed of a columnar roll; and a surface layer that is laminated on a surface of the base body, and that contains fluorine resin and spherical particles having an average particle diameter of about 10 μm to about 50 μm.

6. The fixing device according to claim 5, wherein the spherical particles contained in the surface layer are alumina particles.

7. The fixing device according to claim 1, wherein the fixing member is an endless belt;

the endless belt has a plurality of rolls coming into contact with the endless belt; and the surface shape adjusting member is located upstream of the pressurizing member in a rotation direction of the endless belt, and is one of the plurality of rolls, the one being closest to the pressurizing member.

8. An image forming apparatus comprising:

a toner image forming unit that forms a toner image;

a transfer unit that transfers, onto a recording medium, the toner image formed by the toner image forming unit; and a fixing unit that fixes, on the recording medium, the toner image transferred by the transfer unit onto the recording medium, the fixing unit including:

a fixing roll;

a fixing belt that is laid around the fixing roll;

a pressure roll that forms a pressing portion through which the recording medium passes, the pressing portion being formed between the pressure roll and the fixing belt; and a surface shape adjusting roll that has a surface including a plurality of spherical projections, and that adjusts surface shapes of the fixing belt by providing a plurality of spherical recesses using the plurality of spherical projections while rotating with the surface thereof being in contact with the fixing belt.

9. The image forming apparatus according to claim 8, wherein the surface shape adjusting roll includes a surface layer that contains alumina particles having an average particle diameter of about 10 μm to about 50 μm.

10. An adjustment method of a fixing device including: a fixing member that is driven to rotate; a pressurizing member that is rotated in accordance with rotation of the fixing member while pressing the fixing member, and that forms a pressing portion through which a recording medium passes, the pressing portion being formed between the pressurizing member and the fixing member; and a surface shape adjusting member that has a surface including a plurality of spherical projections; the adjustment method comprising:

causing the surface shape adjusting member to rotate with the surface of the surface shape adjusting member being in contact with the fixing member; and adjusting surface shapes of the fixing member by providing a plurality of recesses on a surface of the fixing member during rotation of the surface shape adjusting member.

* * * * *